US005331941A

United States Patent [19]

Schaffer

[11] Patent Number: 5,331,941

[45] Date of Patent: Jul. 26, 1994

[54] ADJUSTABLE OVERDRAW FOR COMPOUND BOW

[76] Inventor: John P. Schaffer, R.R. 1, Box 105B, Emerado, N. Dak. 58228

[21] Appl. No.: 8,295

[22] Filed: Jan. 25, 1993

[51] Int. Cl.[5] ..... F41B 5/22

[52] U.S. Cl. ..... 124/44.5; 124/25.6; 124/86

[58] Field of Search ..... 124/23.1, 24.1, 25.6, 124/44.6, 86, 88, 89, 44.5

[56] References Cited

U.S. PATENT DOCUMENTS 3,055,353 9/1962 Perrucci .
4,027,645 6/1977 Damron .
4,236,497 12/1980 Troncoso, Jr. .
4,351,311 9/1982 Phares .
4,492,214 1/1985 Kielhoffer .
4,548,189 10/1985 Pietraszek et al. .
4,572,153 2/1986 MacPherson .
4,632,087 12/1986 Cline .
4,643,159 2/1987 Ryan ..... 124/24.1 X
4,662,346 5/1987 Laffin .
4,741,320 5/1988 Wiard .
4,788,961 12/1988 Toth .
4,838,237 6/1989 Cliburn .
5,065,731 11/1991 Smith ..... 124/44.5
5,095,884 3/1992 Mertens ..... 124/44.5
5,140,972 8/1992 Fisk ..... 124/44.5
5,161,514 11/1992 Cary ..... 124/24.1

*Primary Examiner*—Randolph A. Reese
*Assistant Examiner*—John A. Ricci

[57] ABSTRACT

A compound archery bow has an overdraw apparatus allowing use of shorter and lighter arrows. The overdraw apparatus has a rearwardly extended bar secured to the midsection of the bow. A cable guard rod is adjustably mounted on the top portion of the bar for laterally locating cable strands relative to the bow cable. An arrow rest adjustably mounted on the bar has a pair of arrow supporting fingers for supporting an arrow in alignment with the bow string.

20 Claims, 4 Drawing Sheets

ADJUSTABLE OVERDRAW FOR COMPOUND BOW

FIELD OF INVENTION

The invention relates to adjustable overdraw systems for compound hunting bows. The overdraw systems include cable guard rods and arrow rest supports.

BACKGROUND OF INVENTION

Compound hunting bows have been developed to deliver lightweight arrows to a target with substantial power and force. The compound bows have spring limbs supporting pulleys accommodating cables and a bow string. Elongated rods joined to the riser extend in a rearward direction to guide the cables during their draw and release episodes of archery. Arrow rests having fingers for supporting the shaft of an arrow, are separately attached to the riser. An example of an arrow rest is shown by Cliburn in U.S. Pat. No. 4,848,237. Wiard in U.S. Pat. No. 4,741,320 shows a hunting bow having a cable guard rod and slide movable relative to the cable guard rod.

SUMMARY OF INVENTION

The invention is directed to an overdraw apparatus for use with a compound bow by an archer to shoot relatively short arrows at high velocities. The overdraw apparatus permits a decreased arrow length to be used by relocating the arrow rest from the riser to a position rearward of the riser towards the bow string which provides an increase in the velocity of relatively short, lightweight arrows. The overdraw apparatus also has a substantial reduction of noise which is traditionally caused by the released cables as they impact the overdraw bracket.

The overdraw apparatus has an elongated bar secured with a connector plate to a midsection of the riser of the compound bow above the hand grip. The bar extends in a rearward, generally horizontal direction and supports a rearwardly directed cable guard rod. The cable guard rod is adjustably mounted on top of the bar to select the effective length of the cable guard rod relative to the rearward travel of the cables. An arrow rest, having arrow support fingers, is also attached to the bar. The fingers are laterally adjustable on the arrow rest to align the arrow with the bow string. Other types of arrow rests can be attached to the bar to accommodate the arrow. The arrow rest is also longitudinally adjustable along the length of the bar to provide both lateral and longitudinal adjustment of the arrow rest relative to the bar.

DESCRIPTION OF PREFERRED EMBODIMENT

Figure 1:
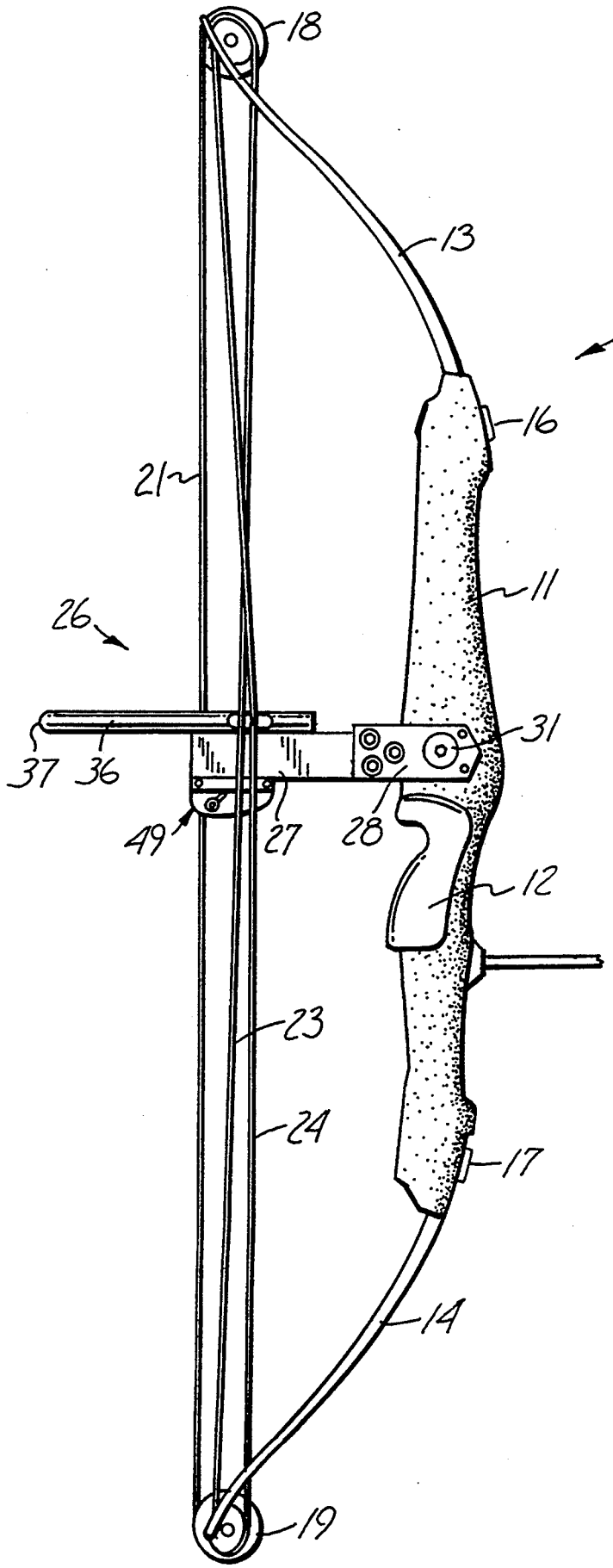
FIG. 1 is a side elevational view of a compound hunting bow equipped with the overdraw apparatus of the invention.

Referring to FIG. 1 of the drawing, there is shown a compound bow indicated generally at 10 used by an archer to shoot relatively short and light weight arrows. Bow 10 has a body or riser 11 having a hand grip 12 immediately below the center of riser 11. Riser 11 is a strong, lightweight metal, such as magnesium alloy, plastic or wood member having channel mounts on opposite ends thereof to accommodate upper and lower flexible limbs 13 and 14. Bolt connectors 16 and 17 secure the inner ends of limbs 13 and 14 to opposite ends of riser 11. Limbs 13 and 14 are generally flat leaf spring structures having recurved configurations. Other types of limbs without recurved shaped can be attached to riser 11. Limbs 13 and 14 may be made of reinforced carbon and other materials. An upper wheel or pulley assembly 18 is rotatably journaled on the outer clevis end of limb 13. In a similar manner, a lower wheel or pulley assembly 19 is rotatably journaled on the lower clevis end of limb 14. A bowstring indicated generally at 21 is trained about wheels 18 and 19 with two cables 23 and 24 spanning the distance between the wheels 18 and 19. Cable 23 has one end connected to pulley assembly 18 and the opposite end attached to the outer end of limb 14. The second cable 24 has one end connected to pulley assembly 19 and the opposite end attached to the outer end of limb 13. Bowstring 21 and cables 23 and 24 are maintained under tension by the biasing forces of limbs 13 and 14. The compound bow 10 as described is conventional bow structure. Other types of bows including high performance bows can be used with the overdraw apparatus of the invention.

An overdraw apparatus of the invention indicated generally at 26 is attached to the mid portion of riser 11 above hand grip 12 and extends rearwardly adjacent bowstring 21. Overdraw apparatus 26 allows the use of shorter arrows as a result of relocating the arrow rest. The velocity of the arrows is increased by the reduction in mass weight of the projectile. There is also a substantial reduction of noise due to the elimination of the cables 23 and 24 impacting the rear of the overdraw when used with a traditionally mounted cable guard.

Figure 3:
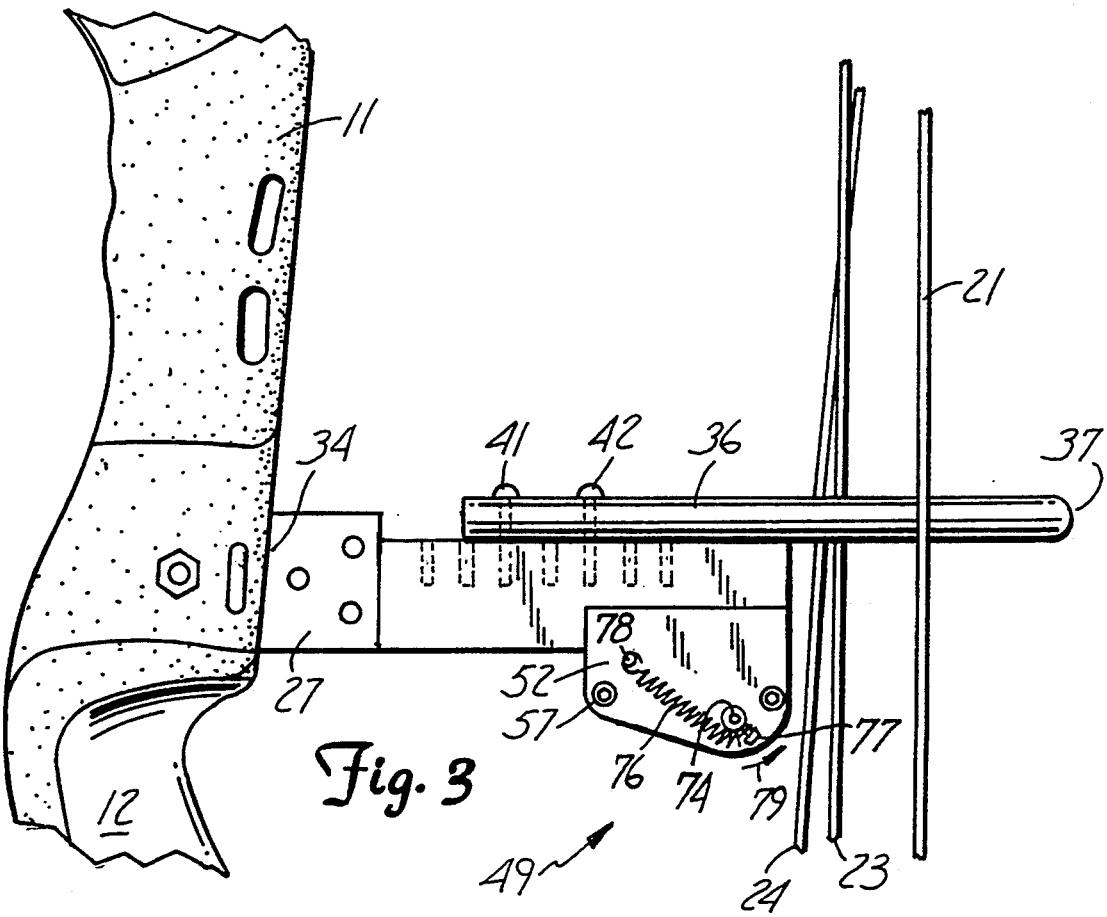
FIG. 3 is an enlarged left side elevational view of the overdraw apparatus connected to the riser of the bow showing the bow string in the static location.
Figure 4:
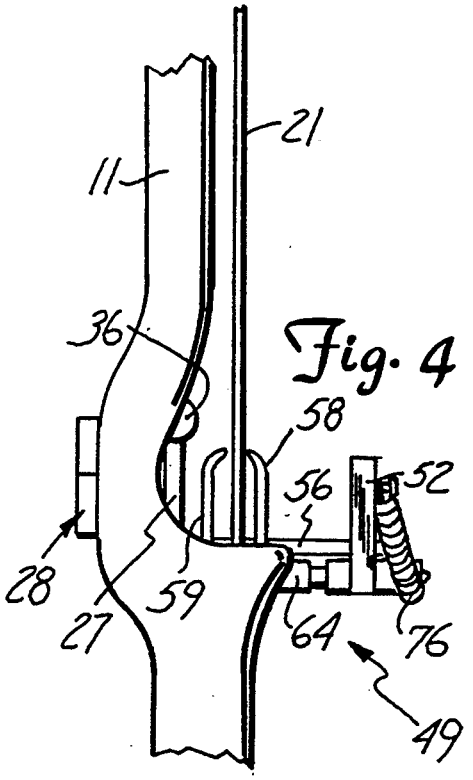
FIG. 4 is a front elevational view of the overdraw apparatus connected to the riser of the bow.
Figure 5:
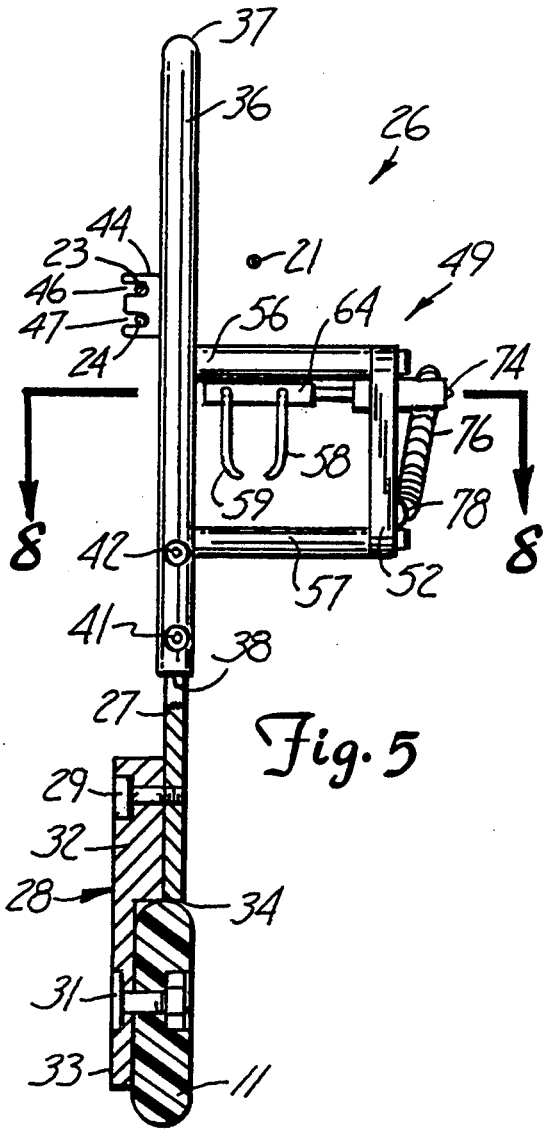
FIG. 5 is an enlarged sectional view taken along the line 5—5 of FIG. 2.

Overdraw apparatus 26 has an elongated generally rectangular bar or support member 27 secured to a connector plate 28 with a plurality of bolts 29. Bar 27 is a common support for a cable guard rod 36 and an arrow rest 49. Side plate 51 of rest 49 is mounted on bar 27 as herein described. Bar 27 is in a vertical plane that is off-set from and parallel to the vertical plane of bow string 21. A bolt 31 secures connector plate 28 to riser 11. As shown in FIG. 5, connector plate 28 has a generally rectangular body 32 that bears against the rear edge of riser 11 and an elongated forwardly directed flat flange 33 located adjacent the side of riser 11. Bolt 31 secures flange to the side of riser 11. Bolts 29 connect plate 27 to body 32. Bolts 29 allow for the longitudinal adjustment of bar 27 relative to connector plate 28 so that the rear end 34 of bar 27 is in firm engagement with riser 11 as seen in FIGS. 3 and 5. Eccentric bolt structures can be used to provide longitudinal adjustment of bar 27 relative to connector plate 28. Other types of structures can be used to provide longitudinal adjustment of bar 27 to ensure that end 34 is in firm engagement with riser 11.

Figure 2:
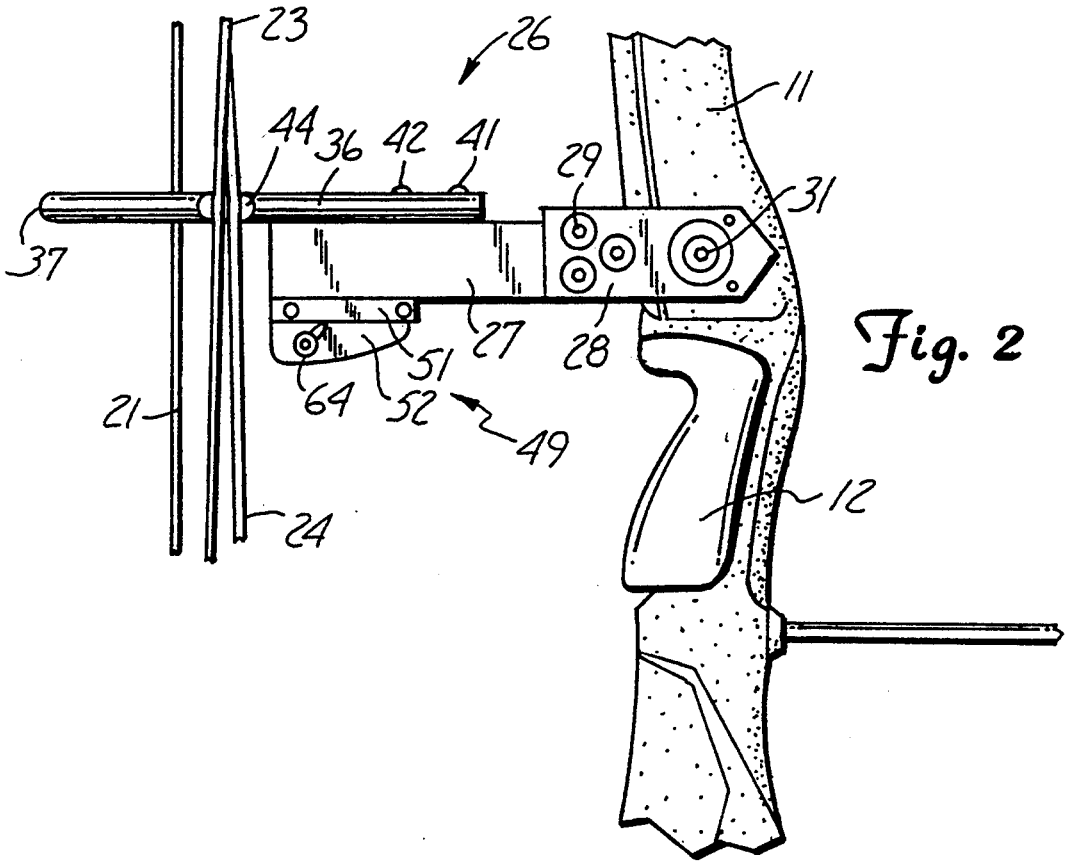
FIG. 2 is an enlarged right side elevational view of the overdraw apparatus connected to the riser of the bow adjacent the hand grip showing the bow string in the static location.
Figure 6:
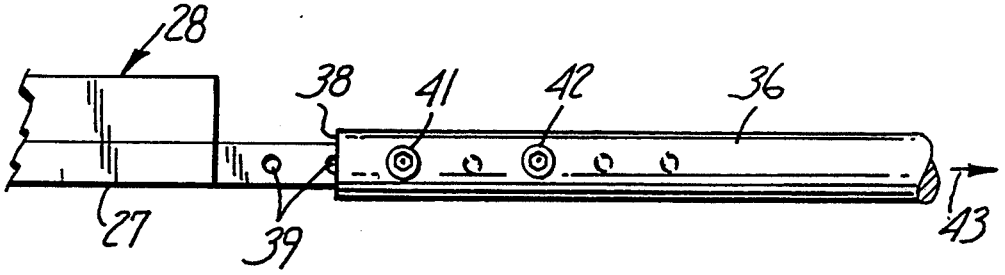
FIG. 6 is an enlarged top plan view of a portion of the overdraw apparatus showing the longitudinal adjustable cable guard rod.

An elongated linear cylindrical cable guard rod 36 having a hemispherical rear end 37 is mounted on top of bar 27 as seen in FIGS. 2 and 3. Bar 27 has a plurality of longitudinally spaced threaded holes 39 that accommodate bolts 41 and 42 for securing cable guard rod 38 to plate 37 in selected longitudinal locations on bar 27. Rod 36 has a flat forward end that allows rod 36 to be located in engagement with the connector 28 when rod 36 is in its short adjusted location. Bolts 41 and 42 can be removed from rod 36 and bar 37 to allow rod 36 to be moved rearwardly relative to bar 37 as indicated by arrow 43 in FIG. 6. Rod 36 is an elongated guide or rail for a slide or cable carrier 44. As seen in FIG. 5, slide 44 is in sliding engagement with a side of rod 36 and has a pair of outwardly open grooves 46 and 47 accommodating cables 23 and 24. Slide 44 is located on the side of rod 36 opposite bow string 21 and retained thereon by the tension on cables 23 and 24. Rod 36 and slide 44 laterally position cables 23 and 24 relative to bow string 21 and arrow rest 49. Slide 44 moves along the length of rod 36 during the draw and the release of the arrow by the archer. Bar 27 has an elongated flat side 48 that is located inwardly from the adjacent outer edge of rod 36 so as not to interfere with movement of slide 44 or the movement of cables 23 and 24 relative to rod 36. The diameter or width of rod 36 is larger than the width of bar 27 so that bar 27 does not interfere with movement of slide 44 along rod 36.

Figure 7:
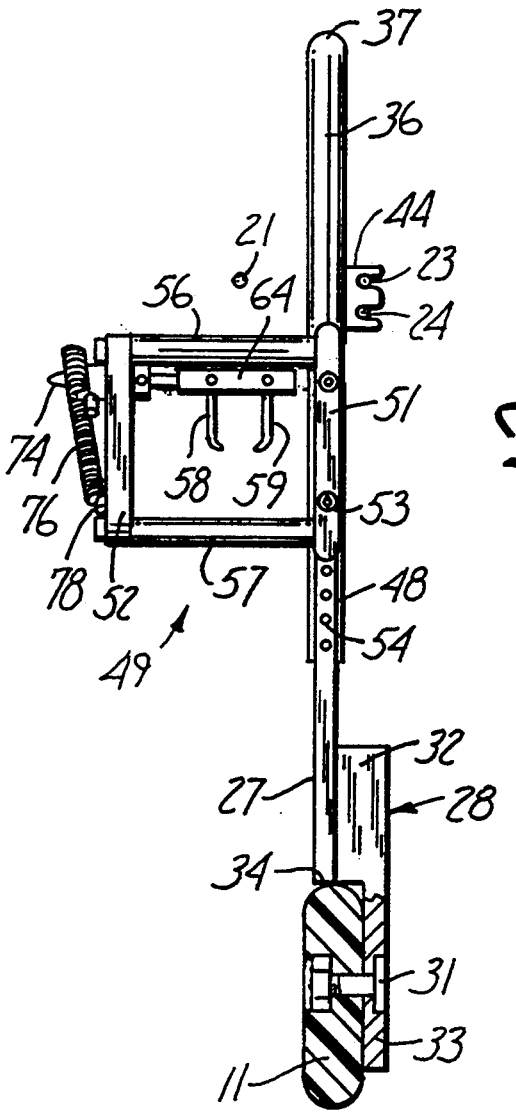
FIG. 7 is a bottom plan view of the overdraw apparatus connected to the riser of the bow.

An arrow rest or support, indicated generally at 49 in FIGS. 2, 4, 5 and 7, is connected to bar 27 below cable guard rod 36 to provide a guide and support for the arrow. Arrow rest 49 has a pair of side plates 51 and 52 that are secured together with cross bars 56 and 57. A plurality of bolts 53, as seen in FIG. 7, are threaded into holes 54 in the bottom of bar 27 to secure arrow rest 49 to bar 27. The bottom of bar 27 has a plurality of longitudinally spaced holes 54 which allow arrow rest 49 to be longitudinally adjusted relative to bar 27.

Figure 8:
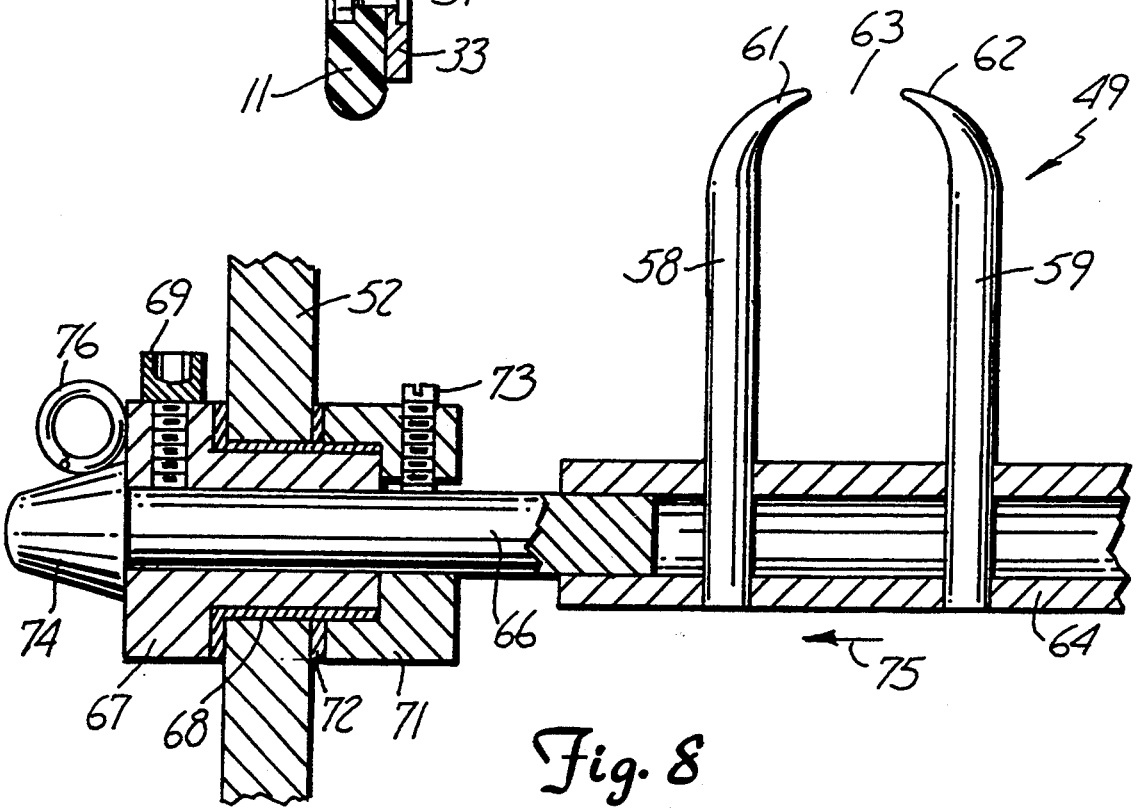
FIG. 8 is an enlarged sectional view taken along the line 8—8 of FIG. 5.

Arrow rest 49 has a pair of generally upwardly and rearwardly directed fingers 58 and 59 having inwardly curved ends 61 and 62 spaced apart by a gap 63. Ends 61 and 62 support the shaft of an arrow prior to the release of bow string 21. Fingers 58 and 59, as seen in FIG. 8, are mounted on a generally transverse tube 64 that is secured to a shaft 66. Shaft 66 extends through a sleeve 67 rotatably mounted on a bearing 68 on side plate 52. A bolt or set screw 69 in sleeve 67 secures shaft 66 to sleeve 67. Sleeve 67 extends through side plate 52 and is surrounded with a collar 71. A washer 72 is interposed between collar 71 and the inside of side plate 62. Set screw 73 in collar 71 secures shaft 66 to collar 71 so that both sleeve 67 and collar 71 rotate with shaft 66 and thereby angularly move fingers 58 and 59. Set screws 69 and 73 allow shaft 66 to be longitudinally moved relative to the sleeve 67 and collar 71 and thereby change the lateral positions of fingers 58 and 59 to adjust the lateral alignment or position of the arrow supported on ends 61 and 62.

The outer end of shaft 66 has an enlarged head 74 that cooperates with a biasing member such as coil spring 76, to hold fingers 58 and 59 in selected inclined positions. An anchor 77 connects one end of coil spring 76 to head 74. A second anchor 78 connects the opposite end of coil spring 76 to side plate 52 as seen in FIG. 3. Coil spring 76 provides a rotating biasing force on head 74 as indicated by arrow 79 thereby biasing fingers 58 and 59 to their forwardly inclined positions. Arrow rest 49 is a conventional arrow rest structure. Other types of arrow rests can be mounted on bar 27 to support an arrow and align the arrow with bow string 21.

In use, overdraw apparatus 26 is used to support the arrow on ends 61 and 62 of fingers 58 and 59 with the nock of the arrow in bow string 21. The archer draws bow string 21 thereby flexing limbs 13 and 14. Cables 23 and 24 move with slide 44 rearwardly along rod 36. Upon release of bow string 21, arrow 79 is projected forwardly toward the selected target. Bow string 21 and cables 23 and 24 snap forwardly free of adverse contact with overdraw apparatus as limbs 13 and 14 return to their initial expanded positions.

The longitudinal position of rod 36 can be adjusted on the bar 26 by repositioning bolts 41 and 42 to different holes 39 thereby changing the effective length of cable guard rod 36. The position of arrow rest 49 can also be adjusted along the length of bar 27 by repositioning bolts 53 relative to holes 54 as seen in FIG. 7. The lateral position of the arrow supporting fingers 58 and 59 can be adjusted by releasing set screws 69 and 73 and changing the lateral position of shaft 66 relative to sleeve 67 and collar 77 as seen in FIG. 8.

While there has been shown and described a preferred embodiment of the overdraw apparatus for a compound bow of the invention, it is understood that changes in the structure, arrangement of structure and parts may be made by those skilled in the art without departing from the invention. The invention is defined in the following claims.

I claim:

1. An overdraw apparatus for a bow used to shoot an arrow, said bow having a riser, limbs secured to the riser, and cable means and a bow string extended under tension between and operably connected to the limbs comprising: a generally flat bar extended rearwardly from the riser toward the cable means, a plate attached to the middle section of the riser, first means connecting the bar to the plate thereby securing the bar to the riser, an elongated cable guard rod extended rearwardly from the bar and said cable means, said cable guard rod being mounted on top of said bar and having a width greater than the width of said bar, second means connecting the cable guard rod to the bar, slide means engageable with the cable guard rod for movement along the length of said cable guard rod, said slide means having means for accommodating portions of the cable means to locate said portions of the cable means adjacent said bar, arrow rest means located adjacent said bar for positioning an arrow relative to the bow string, and third means connecting the arrow rest means to said bar.

2. The apparatus of claim 1 wherein: said bar is located laterally of the bow string.

3. The apparatus of claim 1 wherein: said bar has an end located in engagement with the riser.

4. The apparatus of claim 3 wherein: said first means is adjustable to locate said end of the bar in engagement with the riser.

5. The apparatus of claim 1 wherein: said slide means is located on the side of the cable guard rod opposite said arrow support means to laterally locate said portions of the cable means relative to the bow string.

6. The apparatus of claim 1 wherein: the third means permits longitudinal adjustment of the arrow rest means on said bar.

7. The apparatus of claim 6 wherein: the arrow rest means includes finger means for supporting an arrow, and means for laterally adjusting the location of the finger means to longitudinally align the arrow with the bow string.

8. An overdraw apparatus for a bow used to shoot an arrow, said bow having a riser, limbs secured to the riser, and cable means and a bow string extended under tension between an operably connected to the limbs comprising: a generally flat bar extended rearwardly from the riser toward the cable means, a plate attached to the middle section of the riser, first means connecting the bar to the plate thereby securing the bar to the riser, an elongated cable guard rod extended rearwardly from the bar and said cable means, second means connecting the cable guard rod to the bar, said second means permits longitudinal adjustment of the cable guard rod relative to said bar, slide means engageable with the cable guard rod for movement along the length of said cable guard rod, said slide means having means for accommodating portions of the cable means to locate said portions of the cable means adjacent said bar, arrow rest means located adjacent said bar for positioning an arrow relative to the bow string, and third means connecting the arrow rest means to said bar.

9. An overdraw apparatus for a bow used to shoot an arrow, said bow having a riser, limbs secured to the riser, and cable means and a bow string extended under tension between an operably connected to the limbs comprising: a generally flat bar extended rearwardly. from the riser toward the cable means, a plate attached to the middle section of the riser, first means connecting the bar to the plate thereby securing the bar to the riser, an elongated cable guard rod extended rearwardly from the bar and said cable means, second means connecting the cable guard rod to the bar, the second means includes a plurality of longitudinally spaced threaded holes in said bar and bolts extending through the cable guard rod and located in selected holes to retain said cable guard rod in a selected longitudinal location on said bar whereby the second means permits longitudinal adjustment of the cable guard rod relative to said bar, slide means engageable with the cable guard rod for movement along the length of said cable guard rod, said slide means having means for accommodating portions of the cable means to locate said portions of the cable means adjacent said bar, arrow rest means located adjacent said bar for positioning an arrow relative to the bow string, and third means connecting the arrow rest means to said bar.

10. An overdraw apparatus for a bow used to shoot an arrow, said bow having a riser, limbs secured to the riser, and cable means and a bow string extended under tension between and operably connected to the limbs comprising: a generally flat bar extended rearwardly from the riser toward the cable means, a plate attached to the middle section of the riser, first means connecting the bar to the plate thereby securing the bar to the riser, an elongated cable guard rod extended rearwardly from the bar and said cable means, second means connecting the cable guard rod to the bar, slide means engageable with the cable guard rod for movement along the length of said cable guard rod, said slide means has a pair of grooves accommodating separate portions of the cable means to locate said portions of the cable means adjacent said bar, arrow rest means located adjacent said bar for positioning an arrow relative to the bow string, and third means connecting the arrow rest means to said bar, said slide means being located on the side of the cable guard rod opposite said arrow rest means to laterally locate said separate portions of the cable means relative to the bow string.

11. An overdraw apparatus for a bow used to shoot an arrow, said bow having a riser, limbs secured to the riser, and cable means and a bow string extended under tension between and operably connected to the limbs comprising: a bar extended rearwardly from the riser toward the cable means, connector means attaching the bar to the riser, an elongated cable guard means mounted on top of said bar and extended rearwardly from the bar and cable means, first means for connecting the cable guard means to the bar, slide means engageable with the cable guard means for movement along the length of the cable guard means, said slide means having means for accommodating portions of the cable means to locate said portions of the cable means laterally of the bow string, arrow rest means located adjacent said bar for positioning an arrow relative to the bow string, and second means connecting the arrow rest means to said bar.

12. The apparatus of claim 11 wherein: said bar is located laterally of the bow string.

13. The apparatus of claim 11 wherein: said bar has an end located in engagement with the riser.

14. The apparatus of claim 11 wherein: said slide means is located on the side of the cable guard means opposite said arrow rest means to laterally locate said portions of the cable means relative to the bow string.

15. The apparatus of claim 14 wherein: the first means for connecting the cable guard means to the bar permits longitudinal adjustment of the cable guard means relative to said bar.

16. The apparatus of claim 15 wherein: the first means includes a plurality of longitudinally spaced threaded holes in said bar and bolts extending through the cable guard means and located in selected holes to retain said cable guard means in a selected position on said bar.

17. The apparatus of claim 11 wherein: the second means permits longitudinal adjustment of the arrow rest means on said bar.

18. The apparatus of claim 11 wherein: the arrow rest means includes means for supporting an arrow, and means for laterally adjusting the location of the means for supporting an arrow to longitudinally align the arrow with the bow string.

19. The apparatus of claim 18 wherein: the second means permits longitudinal adjustment of the arrow rest means on said bar.

20. An overdraw apparatus for a bow used to shoot an arrow, said bow having a riser, limbs secured to the riser, and cable means and a bow string extended under tension between an operably connected to the limbs comprising: a bar extending rearwardly from the riser toward the cable means, connector means attaching the bar to the riser, an elongated cable guard means extended rearwardly from the bar and cable means, first means for connecting the cable guard means to the bar, slide means engageable with the cable guard means for movement along the length of the cable guard means, said slide means having a pair of grooves for accommodating two portions of the cable means to locate said portions of the cable means laterally of the bow string, arrow rest means located adjacent said bar for positioning an arrow relative to the bow string, and second means connecting the arrow rest means to said bar, said slide means being located on the side of the cable guard means opposite said arrow rest means to laterally locate said two portions of the cable means relative to the bow string.

* * * * *